US007271371B2

(12) United States Patent
Takematsu et al.

(10) Patent No.: US 7,271,371 B2
(45) Date of Patent: Sep. 18, 2007

(54) MAGNETIC FLUX IMAGE HEATING APPARATUS WITH SHAPED HEAT ROTATION MEMBER

(75) Inventors: Koji Takematsu, Abiko (JP); Koki Watanabe, Moriya (JP); Shinichiro Wakahara, Tokyo (JP); Jiro Shirakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,804

(22) Filed: Oct. 21, 2005

(65) Prior Publication Data

US 2006/0086722 A1 Apr. 27, 2006

(30) Foreign Application Priority Data

Oct. 22, 2004 (JP) ..... 2004-307805

(51) Int. Cl.
*H05B 6/14* (2006.01)
*G03G 15/20* (2006.01)

(52) U.S. Cl. ..... 219/619; 219/652; 399/328; 399/330

(58) Field of Classification Search ..... 219/619, 219/652; 399/328–338
See application file for complete search history.

(56) References Cited

U.S. PATENT DOCUMENTS

| | | | | |
|---|---|---|---|---|
| 7,099,616 | B2 | 8/2006 | Kato et al. | 399/328 |
| 2002/0006296 | A1* | 1/2002 | Omoto et al. | 399/330 |
| 2002/0030050 | A1* | 3/2002 | Takagi et al. | 219/619 |
| 2005/0008413 | A1* | 1/2005 | Takagi et al. | 399/330 |
| 2006/0086721 | A1 | 4/2006 | Wakahara et al. | 219/619 |
| 2006/0086722 | A1 | 4/2006 | Takematsu et al. | 219/619 |
| 2006/0086725 | A1 | 4/2006 | Hosoi et al. | 219/619 |
| 2006/0086727 | A1 | 4/2006 | Takematsu et al. | 219/619 |
| 2006/0086731 | A1 | 4/2006 | Shirakata et al. | 219/645 |
| 2006/0088350 | A1* | 4/2006 | Imamiya | 399/333 |
| 2006/0089314 | A1 | 4/2006 | Wakahara et al. | 514/21 |
| 2006/0120744 | A1 | 6/2006 | Shirakata et al. | 399/68 |
| 2006/0138126 | A1 | 6/2006 | Watanabe | 219/619 |
| 2006/0204292 | A1 | 9/2006 | Kato et al. | 399/328 |

FOREIGN PATENT DOCUMENTS

| | | |
|---|---|---|
| JP | 59-33787 | 2/1984 |
| JP | 2000-29342 | 1/2000 |

* cited by examiner

*Primary Examiner*—Philip H. Leung
(74) *Attorney, Agent, or Firm*—Fitzpatrick, Cella, Harper & Scinto

(57) ABSTRACT

A fixation apparatus having a good fixability in its longitudinal direction and an image forming apparatus are provided. The fixation apparatus includes an electromagnetic induction heating member which is a hollow rotation member, and a magnetic flux generation member for causing the electromagnetic induction heating member to generate heat by generating magnetic flux in the electromagnetic induction heating member. The fixation apparatus fixes a toner image on a recording material by imparting heat energy by heat generation of the electromagnetic induction heating member to the recording material to be conveyed. The electromagnetic induction heating member has a different thickness in the longitudinal direction thereof and a uniform diameter at a surface facing the magnetic flux generation means in the longitudinal direction.

3 Claims, 4 Drawing Sheets

MAGNETIC FLUX IMAGE HEATING APPARATUS WITH SHAPED HEAT ROTATION MEMBER

FIELD OF THE INVENTION AND RELATED ART

The present invention relates to an image heating apparatus for heating an image on a recording material. As the image heating apparatus, there are a fixation apparatus for fixing a unfixed image on the recording material, a gloss-imparting apparatus for improving a gloss of an image by heating the image fixed on the recording material and so on.

An induction heating-type fixation apparatus has been conventionally proposed as described in Japanese Laid-Open Patent Application (JP-A) Sho 59-33787. In this induction heating-type heating apparatus, a coil is concentrically disposed inside a hollow fixation roller formed of a metal conductor and is supplied with a high-frequency current to generate a high-frequency magnetic field, whereby an induction eddy current is generated on the fixation roller to cause the fixation roller per se to generate Joule heat by a skin resistance of the fixation roller itself. According to the induction heating-type fixation apparatus, an electrothermal conversion efficiency is considerably improved compared with a conventional fixation apparatus based on heating with a halogen heater, so that it becomes possible to reduce a warm-up time.

Further, in the induction heating-type fixation apparatus, a heat conversion efficiency is move increased with a smaller gap between the coil and an inner surface of the fixation roller, so that a high distance accuracy is required between the coil and the fixation roller inner surface.

On the other hand, in the conventional halogen heat-type fixation apparatus, an outer diameter of the fixation roller is decreased only at both end portions or as described in JP-A 2000-29342, a rib is provided at an inner surface of the fixation roller, thus improving a strength of the fixation roller.

Even in such a constitution that the distance between the halogen heater and the fixation roller inner surface is different in a longitudinal direction of the fixation roller, an irregularity in temperature occurring in the longitudinal direction of the fixation roller was at such a level that it did not substantially affect a fixation performance.

However, in the case where the fixation roller of the above described halogen heater-type fixation apparatus is used in the induction heating-type fixation apparatus, the distance between the coil and the fixation roller inner surface is different in the longitudinal direction of the fixation roller, so that a temperature of the fixation roller has become nonuniform in the longitudinal direction.

SUMMARY OF THE INVENTION

An object of the present invention is to provide an image heating apparatus capable of suppressing an occurrence of temperature irregularity in a longitudinal direction of a heat rotation member.

Another object of the present invention is to provide an image heating apparatus capable of suppressing the occurrence of temperature irregularity in the longitudinal direction of the heat rotation member while retaining a strength of the heat rotation member.

A further object of the present invention is to provide an image heating apparatus capable of suppressing the occurrence of temperature irregularity in the longitudinal direction of the heat rotation member while suppressing a conveyance failure of a recording material.

According to an aspect of the present invention, there is provided an image heating apparatus, comprising:

a heat rotation member for heating an image on a recording material at a nip portion; and magnetic flux generation means, disposed in the heat rotation member, for generating magnetic flux which causes the heat rotation member to generate heat by induction heating;

wherein the heat rotation member has a difference in outer diameter between a central portion and both end portions in a longitudinal direction thereof and has an inner diameter to provide a gap between the heat rotation member and the magnetic flux generation means is substantially uniform in the longitudinal direction.

According to another aspect of the present invention, there is provided an image heating apparatus, comprising:

a heat rotation member for heating an image on a recording material; and magnetic flux generation means for generating magnetic flux which causes the heat rotation member to generate heat by induction heating;

wherein said heat rotation member has a longitudinal sectional shape so that it is non-straight at a side thereof remote from said magnetic flux generation means but is straight at a side thereof near said magnetic flux generation means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, preferred embodiments of the present invention will be described more specifically with reference to the drawings. In the following embodiments, dimensions, materials, and shapes of respective constitutional members or means and their relative arrangements do not limit a scope of the present invention thereto unless otherwise specified. Further, redundant explanations therefor are omitted unless otherwise noted specifically.

Figure 1:
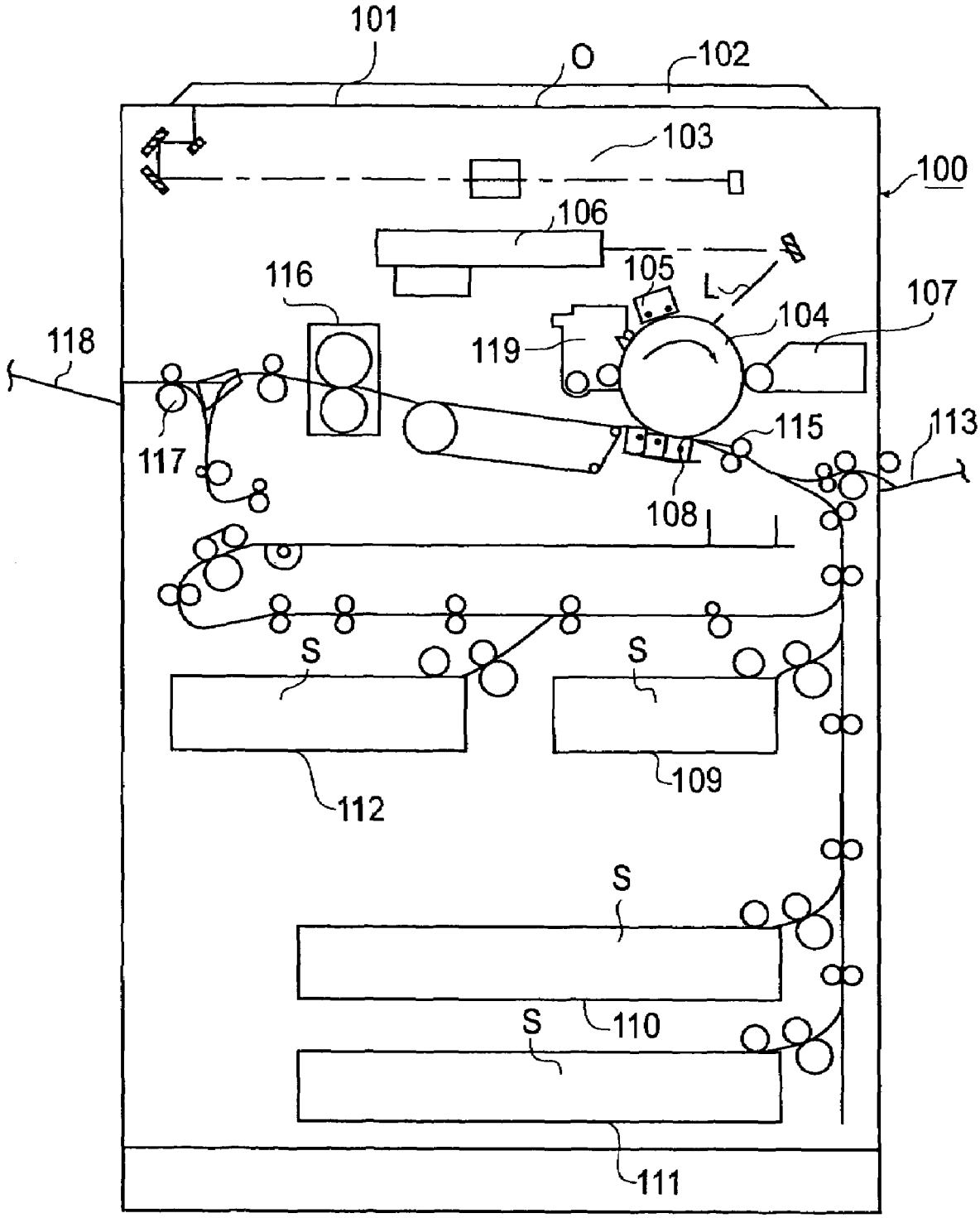
FIG. 1 is a schematic sectional view of an image heating apparatus including an electromagnetic induction heating-type fixation apparatus according to an embodiment of the present invention.
Figure 2:
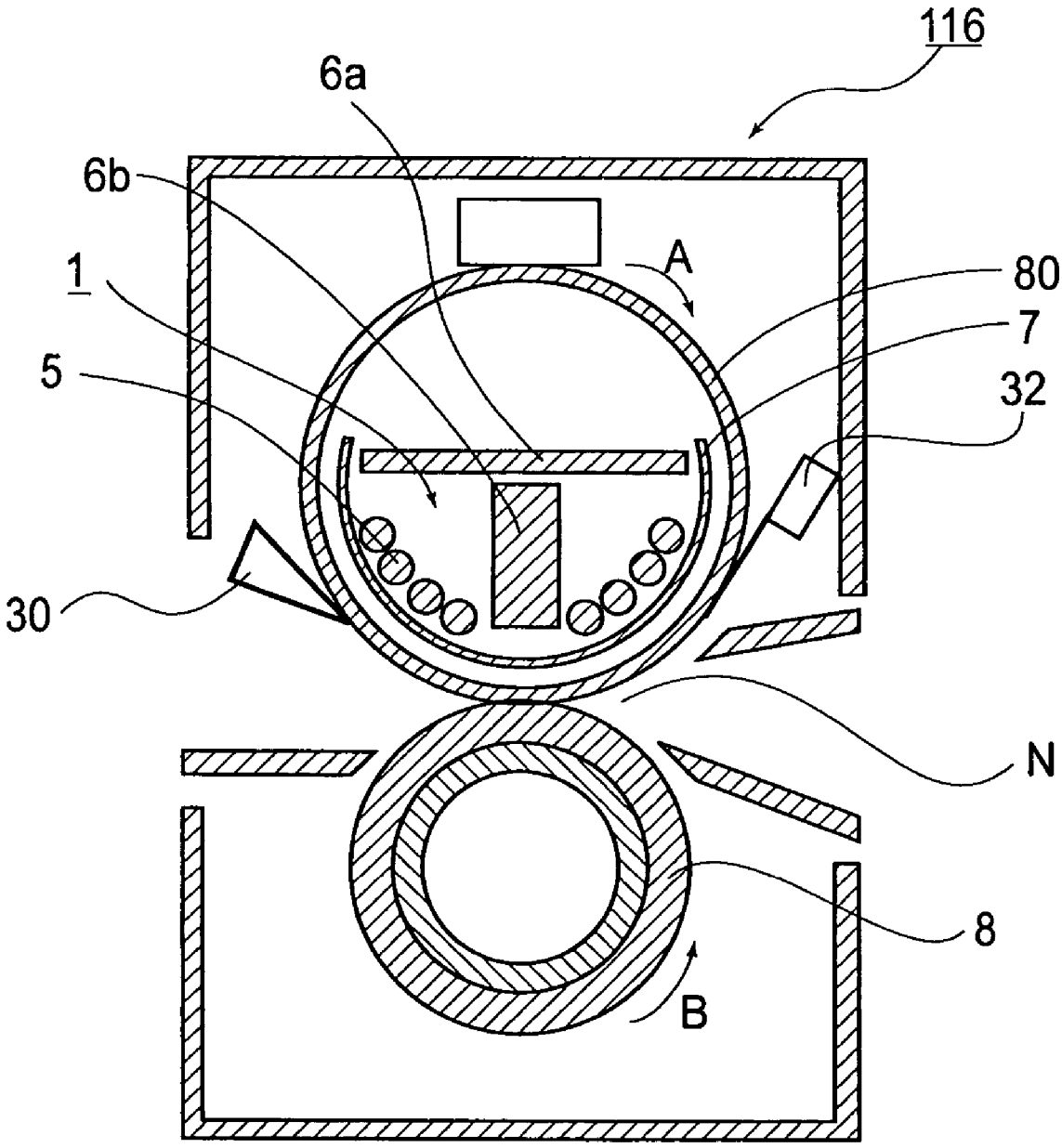
FIG. 2 is a sectional view of the fixation apparatus according to the embodiment of the present invention.

FIG. 1 is a schematic sectional view of an image forming apparatus including an electromagnetic induction-type fixation apparatus according to an embodiment of the present invention. FIG. 2 is a sectional view of the fixation apparatus of this embodiment.

First, a constitution and operation of an image forming apparatus 100 will be described. A user places an original O on an original-supporting glass plate 101 with an image forming surface down in accordance with a predetermined placing standard and covers the original O with an original pressing plate 102. When a copy start key is pressed, an image photo-reader (reader portion) 103 including a moving optical system is actuated to effect photo reading processing of image information at the downward image surface of the original O on the original-supporting glass plate 101.

A rotation drum-type electrophotographic photosensitive member (hereinafter referred to as a "photosensitive drum") 104 is rotationally driven at a predetermined peripheral speed in a clockwise direction indicated by an arrow. During the rotation, the photosensitive drum 104 is electrically charged uniformly to a predetermined polarity and a predetermined electric potential by a charging apparatus 105 and the uniformly charged surface of the photosensitive drum 104 is exposed to imagewise exposure light L by an image writing apparatus 106. As a result, a potential of the exposed light portion at the uniformly charged surface is attenuated to form an electrostatic latent image corresponding to an exposure light pattern at the surface of the photosensitive drum 104.

The image writing apparatus 106 in this embodiment is a laser scanner and outputs laser light L modulated in correspondence with a time-series electric digital signal of the original image information read by the above-described photo-reader 103 to perform scanning exposure on the uniformly charged surface of the rotating photosensitive drum 104 to form an electrostatic latent image corresponding to the original image information.

Then, the electrostatic latent image is developed as a toner image by a developing apparatus 107 and is electrostatically transferred by a transfer apparatus 108 from the surface of the photosensitive drum 104 onto a recording material S fed from a feeding mechanism portion at a predetermined control timing to a transfer portion where the photosensitive drum 104 and the transfer apparatus 108 are disposed opposite to each other.

In this embodiment, an image forming portion for forming the toner image on the recording material is constituted by the photosensitive drum 104, the charging apparatus 105, the image writing apparatus 106, the developing apparatus 107, and the transfer apparatus.

The feeding mechanism portion in this embodiment is constituted by first to four cassette-type feeding portions 109-112, a multi-purpose (MP) tray 113, and an inversion re-feeding portion 114. From these portions, the recording material S is selectively fed to the transfer portion. Registration rollers 115 feed the recording material to the transfer portion at a predetermined timing.

The recording material S onto which the toner image is transferred from the photosensitive drum 104 at the transfer portion is separated from the photosensitive drum 104 and conveyed to a fixation apparatus 116 by which a fixing treatment of an unfixed toner image is performed, thus being discharged (outputted) on a discharge (output) tray 118, located outside the image forming apparatus, by a discharge (output) roller 117.

On the other hand, the surface of the photosensitive drum 104 after the recording material S is separated therefrom is cleaned by removing therefrom contamination such as transfer residual toner or the like and is then used for subsequent image formation.

Next, with reference to FIG. 2, the fixation apparatus as an image heating apparatus will be described.

As shown in FIG. 2, a fixation roller 80 as a heat rotation member has a hollow shape and is rotatably supported between front and rear side plates via bearings.

As a material for the fixation roller 80, it is possible to use iron or an alloy of iron and nickel. At an outer surface of the fixation roller 80, an unshown toner release layer is formed. In this embodiment, the toner release layer is formed of PTFE in a thickness of 30 μm.

A heating assembly 1 is disposed inside the fixation roller 80 and constituted by an exciting coil 5 as a magnetic flux generation means, an exciting core (horizontal portion) 6*a*, an exciting core (vertical portion) 6*b*, and a holder 7.

As the exciting cores 6*a* and 6*b*, a material, such as permalloy, having a high permeability and a low residual magnetic flux density may preferably be used. The constitution of the heating assembly is not limited to such a constitution but may be any constitution so long as it is capable of causing the fixation roller 80 to generate magnetic flux to result in heat generation of the fixation roller 80 by induction heating.

A pressure roller 8 as a pressure rotation member is an elastic member disposed under and in parallel with the fixation roller 80 and rotatably supported between bearings. Further, the pressure roller 8 is pressed against the lower surface of the fixation roller 80 at a predetermined pressing force by an unshown urging means, thus forming a fixation nip portion N as a heating portion having a predetermined width. Further, the pressure roller 8 has such a constitution that a silicone rubber layer is formed at an outer surface of an iron-made core metal and a toner release layer is formed at an outermost surface.

The fixation roller 80 is rotationally driven at a predetermined peripheral speed in a direction of an arrow A indicated in FIG. 2 by transmitting a rotational force from a drive power source to a fixation roller gear secured to one end portion of the fixation roller 80. The pressure roller 8 is rotated in a direction of an arrow B by the rotation of the fixation roller 80.

To the exiting coil 5 of the heating assembly 1 disposed inside the fixation roller 80, power is supplied from a power control apparatus (exciting circuit) through a coil supply line. In this embodiment, a high-frequency current of 10 kHz is supplied, whereby the fixation roller 80 is caused to generate heat by induction heating (Joule heating due to eddy-current loss) by the action of magnetic flux (alternating magnetic field) generated from the exciting coil. A temperature of the fixation roller 80 is detected by a temperature detection means 32, such as a thermistor, and a detection temperature signal is inputted into a control circuit.

The control circuit controls power supplied from the above described power control apparatus to the exciting coil 5 so that the detected temperature of the fixation roller 80 inputted from the temperature detection means 32 is kept at a predetermined fixing temperature (200° C. in this embodiment). As a result, it is possible to keep the temperature of the fixation roller 80 at the predetermined fixing temperature.

As described above, the fixation roller 80 and the pressure roller 8 are rotationally driven and the recording material S carrying thereon the unfixed toner image is introduced into the fixation nip portion N of the fixation apparatus 116 in such a state that the fixation roller 80 is temperature-controlled at the predetermined fixing temperature.

The fixation apparatus 116 heats and fixes the toner image on the recording material S while conveying the recording material S between the fixation roller 80 and the pressure roller 8 at the fixation nip portion N between the rollers.

A separation claw 30 has functions of suppressing winding of the recording material S passed through the fixation nip portion N about the fixation roller 80 and separating the recording material S from the fixation roller 80.

Figure 3:
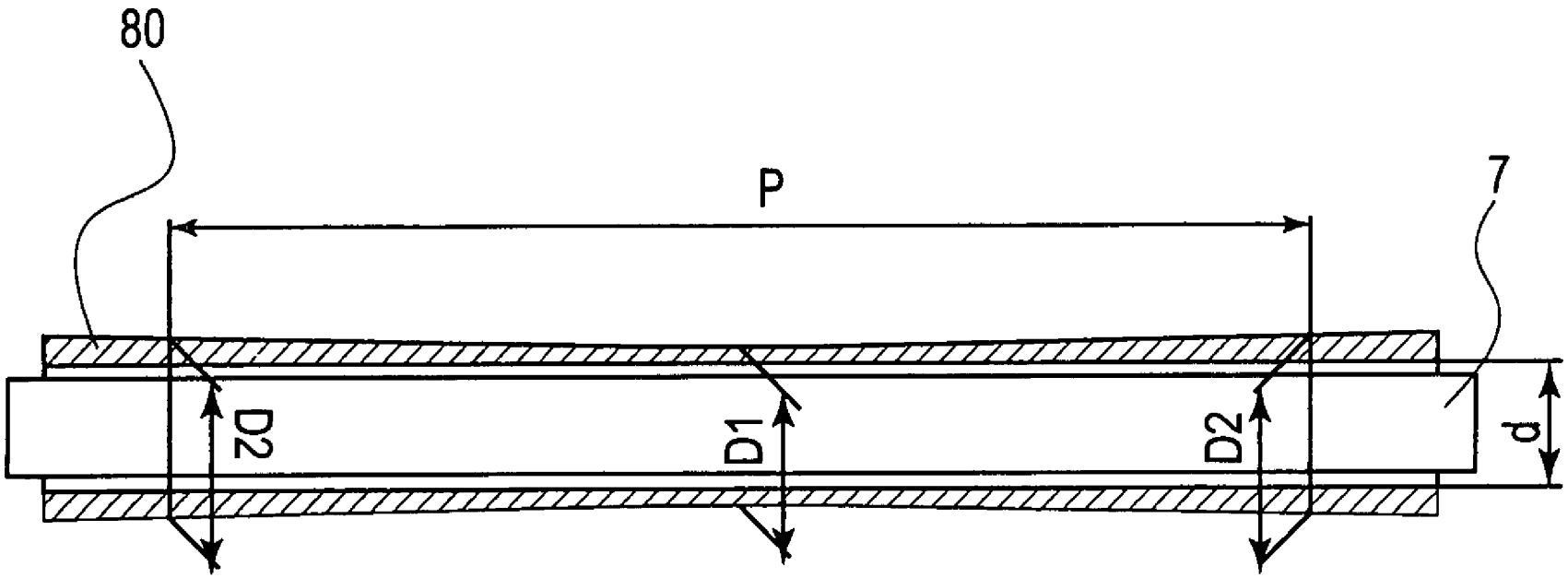
FIG. 3 is a longitudinal sectional view of a fixation roller according to the embodiment of the present invention.

FIG. 3 is a sectional view of the fixation roller 80 in a longitudinal direction. Here, a width P is somewhat broader than a width of maximum-sized sheet recommended for use in the image forming apparatus and is 330 mm in this embodiment. The fixation roller 80 has a substantially circular cross section over the entire longitudinal direction in a direction perpendicular to the longitudinal direction of the fixation roller 80.

The fixation roller 80 has such a longitudinal sectional shape that the fixation roller 80 has a constant inner diameter d in the longitudinal direction. On the other hand, the fixation roller 80 has a slightly reverse camber shape (curve) at its outer surface, so that it becomes possible to prevent an occurrence of crease of sheet during conveyance of the sheet by the fixation roller 80. In other words, it is possible to improve conveyance performance.

More specifically, when an outer diameter of the fixation roller 80 at a central portion in the longitudinal direction is D1 and an inner diameter of the fixation roller 80 at both end portions in the longitudinal direction is D2, a relationship: D1<D2 is satisfied. The outer diameter is identical to a value which is twice a diameter (radius) from a rotation center (reference point) to an outer peripheral surface of the fixation roller 80. This is true for the inner diameter.

Incidentally, in the case where the fixation roller 80 is formed in a smaller thickness for the purpose of reduction in warm-up time, a strength of the fixation roller is liable to be lowered. In order to suppress the lowering in strength of the fixation roller, the outer diameter of the fixation roller may vary in the longitudinal direction.

Figure 4:
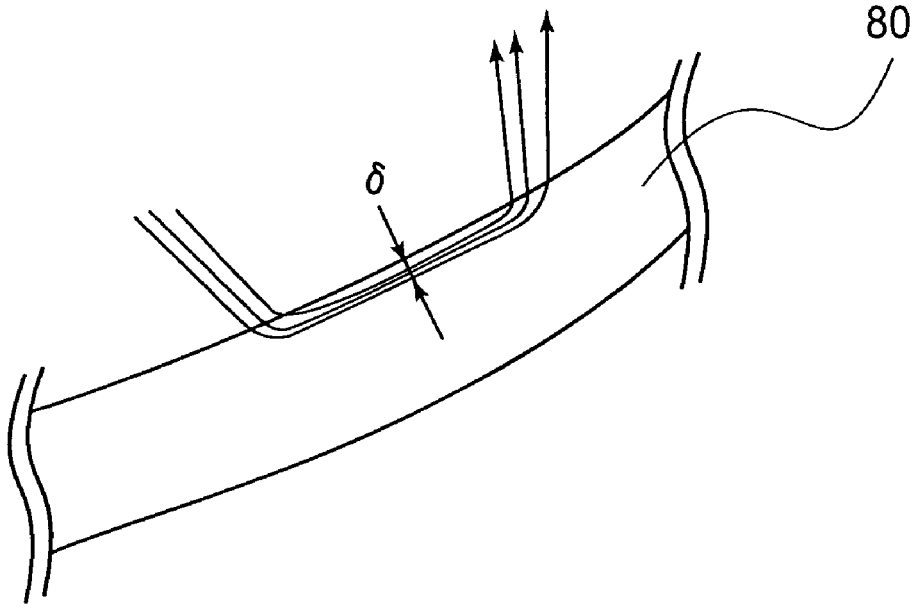
FIG. 4 is a schematic view showing a state of lines of magnetic force at a temperature less than Curie temperature (point).

Next, a heating principle of the induction heating type fixation apparatus will be described. Magnetic lines of force generated from the magnetic flux (magnetic field) generation means passes concentratedly through a surface portion of the fixation roller 80 as shown in FIG. 4, and a density thereof is decreased exponentially with a depth from the surface of the fixation roller 80 (skin effect). Herein, a depth from the surface of the fixation roller 80 at a point where a value of eddy current is decreased to a value which is 0.368 time a current density at the surface is referred to as a "penetration depth d" and is represented by the following formula (1):

$$d=5.03(\rho/\mu f)^{1/2} \quad (1),$$

wherein f represents an exciting current frequency of the magnetic flux generation means, μ represents a relative permeability of the electromagnetic induction heating member, and ρ represents a resistivity of the electromagnetic induction heating member.

Further, a skin resistance Rs is represented by the following formula (2):

$$Rs=\rho/d \quad (2).$$

The fixation roller 80 is heated by Joule heat due to the skin resistance Rs.

Figure 5:
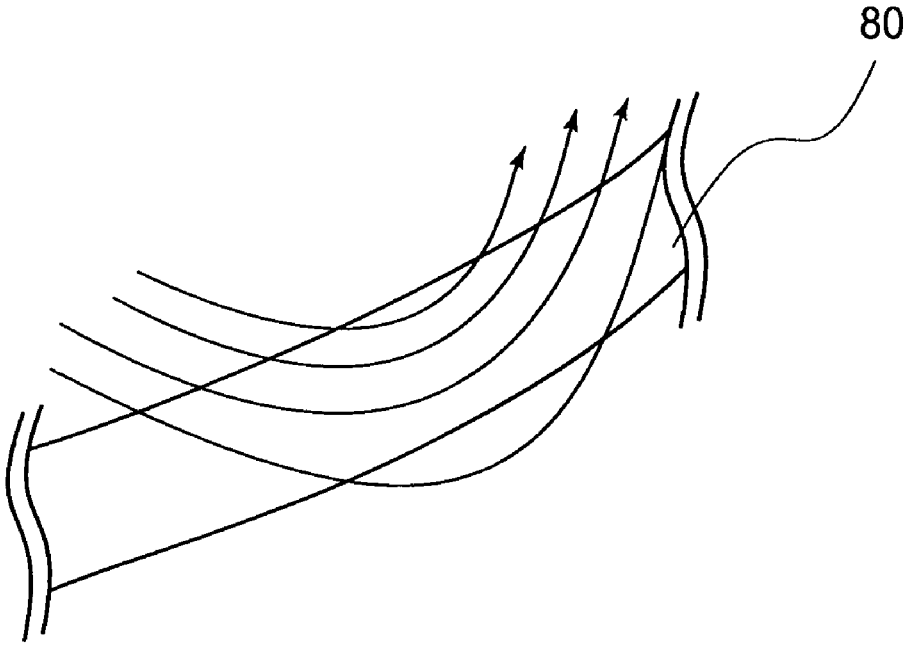
FIG. 5 is a schematic view showing a state of lines of magnetic force at a temperature not less than Curie temperature.

Incidentally, in the electromagnetic induction heating-type fixation apparatus, in the case where the thickness of the fixation roller is smaller than the penetration depth d, magnetic lines of force generated from the coil passes completely through the fixation roller 80 and leaked outside the fixation roller 80 as shown in FIG. 5.

The leakage fluxes do not adversely affect the outside of the image forming apparatus but in the case where a member susceptible to a signal line or heat generation is intended to be disposed in the neighborhood of the fixation apparatus, it is necessary to take such measures that a distance between the member and the coil is increased or that a magnetic flux shielding member is disposed. In this embodiment, as described later, the thickness of the fixation roller is appropriately set.

A distance between the inner peripheral surface of the fixation roller 80 and the outer peripheral surface of the exciting coil 5 held in the holder 7 is about 3.3 mm and is substantially constant in the longitudinal direction. Incidentally, the distance between the inner peripheral surface of the fixation roller 80 and the outer peripheral surface of the exciting coil 5 can be substantially constant in the longitudinal direction at least in a maximum image heating area P of the fixation roller 80.

Therefore, in the electromagnetic induction heating-type fixation apparatus having a good heating efficiency, it becomes possible to keep a temperature distribution in the longitudinal direction of the fixation roller 80 at a constant level. As a result, an irregularity in temperature in the longitudinal direction of the fixation roller 80 is not caused to occur, so that a fixability can be improved. Incidentally, inside the fixation roller 80, the holder 7 is fixed by front and rear side plates of the image forming apparatus.

In this embodiment, the fixation roller 80 has the inner diameter d of 39 mm, the outer diameter D1 at the central portion is 40.245 mm, and the outer diameter D2 at the both end portions is 40.3 mm. Hereinbelow, these values will be described more specifically.

The fixation roller 80 is temperature-controlled so that a roller surface temperature thereof is 200° C., by the temperature detection means 32. As a result, the temperature does not exceed a Curie temperature of iron during standby or in a sheet passing area during sheet passing operation.

For this reason, the magnetic lines of force generated from the magnetic flux generation means penetrate into the fixation roller 80 by a penetration depth d calculated in the following manner according to the formula (1) described above.

In this embodiment, the fixation roller 80 is formed of iron and has a relative permeability μ of 80 before the temperature thereof reaches the Curie temperature and a resistance ρ is $1.28\times10^{-7}$ ohm·m. Further, an exciting current frequency f is 8000 Hz.

Accordingly, from the formula (1) described above, d $B=5.03(\rho/\mu f)^{1/2}=0.00012$ m=0.12 mm.

For this reason, a minimum thickness $t_{min}$ calculated from the inner diameter d and the central portion outer diameter D1 may preferably be larger than the penetration depth d, so that the following formula (3) may preferably be satisfied:

$$d(\min)=(D1-d)/2=t_{min} \quad (3).$$

Further, according to preliminary study, it has been confirmed that a warm-up time of the iron-made fixation roller 80 of the magnetic induction heating type exceeds 30 sec when the thickness of the fixation roller is larger than 1.0 mm. For this reason, the inner diameter d and the central portion outer diameter D1 of the fixation roller in the present invention may preferably satisfy the following formula (4):

$$(D1-d)/2=1.0 \text{ mm} \quad (4).$$

Accordingly, these diameters d and D1 and the penetration depth d may preferably satisfy the following formula (5):

$$d(\text{mm})=(D1-d)/2=1.0 \text{ mm} \quad (5).$$

Further, it has been conventionally known that the outer diameter at the both end portions is made appropriately larger than the central portion outer diameter of the roller during the sheet passing operation, i.e., that creases of sheet (paper) can be prevented by providing a reverse chamber shape to the fixation roller.

According to preliminary study, it has been confirmed that the sheet crease can be prevented the following formula (6) is satisfied:

$$0.02\text{ mm}=(D2-D1)/2=0.15\text{ mm} \quad (6).$$

More specifically, the sheet crease can be prevented by making a peripheral speed of the roller at the both end portions higher than that at the central portion so as to achieve an effect of smoothing down the creases. Accordingly, the sheet crease prevention effect depends on the outer diameters of the rollers (the fixation roller and the pressure roller).

At the same time, from the viewpoint of ensuring a fixability, the pressure roller 8 is pressed against the fixation roller 80 at a total pressure of 90 kgf. Further, according to preliminary study, the minimum thickness $t_{min}$ of the fixation roller 80 was required to satisfy the following formula (6) in order to ensure the strength of the fixation roller 80.

$$t_{min}=0.5\text{ mm} \quad (7).$$

In the fixation apparatus 116 of this embodiment, the fixation roller may preferably be formed in a shape having d=39 mm, D1=40.245 mm, and D2=40.3 mm as a shape capable of reducing the warm-up time and keeping the temperature distribution at the surface of the fixation roller 80 in the longitudinal direction while satisfying the above described conditions (formulas).

Incidentally, in this embodiment, as the material for the fixation roller, iron is used but it is also possible to use a magnetism-adjusted alloy effective in preventing temperature rise at a non-sheet passing portion. Herein, the magnetism-adjusted alloy means an alloy having such a property that it loses magnetism at high temperature, and a temperature at which the magnetism is lost is referred to as a Curie temperature. The Curie temperature of Fe—Ni magnetism-adjusted alloy varies depending on a content of Ni in the alloy.

For example, it is also possible to prepare a fixation roller formed of a Fe—Ni alloy having a mixing ratio so as to provide a Curie temperature (temperature of loss in magnetism) of 220° C. By using such a magnetism-adjusted alloy, it becomes possible to set the Curie temperature of the fixation roller 80 at a desired value. As a result, it is possible to solve such a problem that the fixation roller temperature at the non-sheet passing portion is higher than a predetermined temperature by constantly keeping the temperature of the fixation roller 80 at approximately 220° C. at the non-sheet passing portion without using a complicated constitution and lowering a productivity such as a decrease in throughput.

Incidentally, in the above described embodiments, as the image heating apparatus, the fixation apparatus for fixing the unfixed image on the recording material is described as an example but the present invention is also applicable to a gloss-imparting apparatus for improving a ghost of an image by re-heating an image fixed on a recording material.

As described hereinabove, according to the constitution of the present invention, it is possible to realize a good temperature distribution of the fixation roller in the longitudinal direction while ensuring an improvement in conveyance performance of the recording material and a strength of the fixation roller.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 307805/2004 filed Oct. 22, 2004, which is hereby incorporated by reference.

What is claimed is:

1. An image heating apparatus, comprising:

magnetic flux generation means, comprising a coil, for generating magnetic flux;

a heat rotation member comprising an electroconductive layer which has a substantially uniform inner diameter in a rotation axis direction of said heat rotation member, an outer diameter at an end portion larger than an outer diameter at a central portion in the rotation axis direction, and a thickness at the central portion larger than a penetration depth of the magnetic flux, said heat rotation member containing therein said magnetic flux generation means so as to heat an image on a recording material by heat generated in the electroconductive layer through the magnetic flux from said magnetic flux generation means; and a pressing member for conveying the recording material while pressing said heat rotation member.

2. An apparatus according to claim 1, wherein said heat rotation member satisfies the following relationships:

$$d<(D1-d)/2=1.0,$$

$$0.02\mathbf{32}\ (D2-D1)/2=0.15,$$

wherein D1 represents an outer diameter (mm) of said heat rotation member at the central portion in the longitudinal direction, D2 represents an outer diameter (mm) of said heat rotation member at the both end portions in the longitudinal direction, d represents an inner diameter (mm) of said heat rotation member, and d represents a penetration depth (mm) of said heat rotation member.

3. An apparatus according to claim 1, wherein said magnetic flux generation means is a coil unit disposed substantially parallel to the straight shape of the electroconductive layer.

* * * * *

UNITED STATES PATENT AND TRADEMARK OFFICE

CERTIFICATE OF CORRECTION

PATENT NO. : 7,271,371 B2
APPLICATION NO. : 11/254804
DATED : September 18, 2007
INVENTOR(S) : Koji Takematsu et al.

It is certified that error appears in the above-identified patent and that said Letters Patent is hereby corrected as shown below:

COLUMN 1:
Line 11, “a” (first occurrence) should read --an--.
Line 46, “above” should read --above- --.
Line 51, “has become” should read --becomes--.

COLUMN 2:
Line 10, “heating;” should read --heating,--.
Line 23, “heating;” should read --heating,--.

COLUMN 4:
Line 51, “above described” should read --above-described--.

COLUMN 5:
Line 43, “time” should read --times--.
Line 63, “passes” should read --pass--.
Line 64, “leaked” should read --leaks--.

COLUMN 7:
Line 8, “prevented the” should read --prevented when the--.
Line 23, “formula (6)” should read --formula (7)--.
Line 32, “above” should read --above- --.
Line 56, “above” should read --above described--.

UNITED STATES PATENT AND TRADEMARK OFFICE

CERTIFICATE OF CORRECTION

PATENT NO. : 7,271,371 B2
APPLICATION NO. : 11/254804
DATED : September 18, 2007
INVENTOR(S) : Koji Takematsu et al.

It is certified that error appears in the above-identified patent and that said Letters Patent is hereby corrected as shown below:

COLUMN 8:

Line 3, "ghost" should read --gloss--.

Line 41, "d<(D1 - d)/2 = 1.0," should read --d<(D1 - d)/2 = 1.0--.

Line 43, "0.0232 (D2-D1)/2=0.15" should read --0.02 = (D2-D1)/2=0.15,--.

Line 50, "d represents" should read --d represents--.

Signed and Sealed this

Tenth Day of February, 2009

JOHN DOLL
*Acting Director of the United States Patent and Trademark Office*